US008915413B2

(12) United States Patent
Kayser

(10) Patent No.: US 8,915,413 B2
(45) Date of Patent: Dec. 23, 2014

(54) DEVICE FOR OPENING AN AMPOULE

(75) Inventor: Ralph Egon Kayser, Luzern (CH)

(73) Assignee: Medmix Systems AG, Rotkreuz (CH)

( * ) Notice: Subject to any disclaimer, the term of this patent is extended or adjusted under 35 U.S.C. 154(b) by 0 days.

(21) Appl. No.: 13/639,694

(22) PCT Filed: Mar. 10, 2011

(86) PCT No.: PCT/CH2011/000047
§ 371 (c)(1),
(2), (4) Date: Oct. 5, 2012

(87) PCT Pub. No.: WO2011/123960
PCT Pub. Date: Oct. 13, 2011

(65) Prior Publication Data

US 2013/0032623 A1 Feb. 7, 2013

(30) Foreign Application Priority Data

Apr. 8, 2010 (CH) ..... 507/10

(51) Int. Cl.
*B67B 7/92* (2006.01)

(52) U.S. Cl.
CPC ..... *B67B 7/92* (2013.01)
USPC ..... 225/97; 225/93; 225/103

(58) Field of Classification Search
CPC ..... B67B 7/92; A61M 5/24; A61M 5/2425; A61M 5/2429; A61M 5/2448; A61M 5/2455; A61M 5/28; A61M 5/282; A61M 5/283; A61M 5/285; B26F 3/00; B26F 3/002
USPC ..... 225/93, 97, 102–104; 83/199; 241/99; 604/181, 182, 200, 87; 222/83.5, 87, 222/88, 541.1–541.4, 541.6
See application file for complete search history.

(56) References Cited

U.S. PATENT DOCUMENTS 984,654 A 2/1911 Felbel
4,304,869 A * 12/1981 Dyke ..... 435/287.6

(Continued)

FOREIGN PATENT DOCUMENTS

| | | | |
|---|---|---|---|
| DE | 29 21 565 | A1 | 12/1980 |
| DE | 198 41 722 | A1 | 3/2000 |
| EP | 0 040 959 | A1 | 12/1981 |
| EP | 0 079 983 | A1 | 6/1983 |
| EP | 1 044 666 | A1 | 10/2000 |
| FR | 2 209 292 | A5 | 6/1974 |
| WO | 97/07748 | A1 | 3/1997 |

OTHER PUBLICATIONS

International Search Report for PCT/CH2011/000047 dated Jun. 27, 2011.

*Primary Examiner* — Phong Nguyen
(74) *Attorney, Agent, or Firm* — Sughrue Mion, PLLC

(57) ABSTRACT

A device for opening an ampoule (3) comprises a hollow cylindrical housing (11) having an interior for accommodating the ampoule (3) and a rotary element (12) having a proximal section (121), to which a break-off section (124) extending in a distal direction is connected to. The break-off section (124) is flexible in a radial direction and is pivotably connected to the proximal section (121) in the radial direction. The rotary element (12) is rotatable relative to the housing (11) about the longitudinal axis. The housing (11) has a first guiding structure (119) for pressing the break-off section (124) inward during a rotation of the rotary element so that the break-off section (124) exerts a radial shear force on an ampoule head (33) of an ampoule (3) to break the ampoule head (33) off of the ampoule body (31).

25 Claims, 6 Drawing Sheets

(56) References Cited

U.S. PATENT DOCUMENTS

| | | | | |
|---|---|---|---|---|
| 4,506,817 | A * | 3/1985 | Parker | 225/96.5 |
| 4,528,268 | A * | 7/1985 | Andersen et al. | 435/31 |
| 4,732,850 | A * | 3/1988 | Brown et al. | 435/31 |
| 5,129,566 | A * | 7/1992 | Ogden et al. | 225/93 |
| 5,335,824 | A | 8/1994 | Weinstein | |
| 6,099,510 | A | 8/2000 | Ruther | |
| 6,244,487 | B1 * | 6/2001 | Murray | 225/93 |
| 6,296,149 | B1 | 10/2001 | Long | |
| 6,832,703 | B1 | 12/2004 | Scott | |
| 7,946,461 | B2 * | 5/2011 | Wiley et al. | 225/1 |

* cited by examiner

DEVICE FOR OPENING AN AMPOULE

CROSS REFERENCE TO RELATED APPLICATIONS

This application is a National Stage of International Application No. PCT/CH2011/000047 filed Mar. 10, 2011, claiming priority based on Swiss Patent Application No. 00507/10 filed Apr. 8, 2010, the contents of all of which are incorporated herein by reference in their entirety.

TECHNICAL FIELD

The present invention relates to a device for opening an ampoule. The device comprises a housing for accommodating an ampoule and is designed to break the ampoule head off from the ampoule body.

PRIOR ART

Ampoules are often used, particularly in medicine and chemistry, to store fluid products, for example medicinal products or aggressive substances such as monomers in a sterile manner and protected against diffusion. Conventional ampoules are generally made of glass and have an interior, which is entirely closed off with regard to the exterior, in which the fluid product is stored. Such ampoules are usually elongated and have an ampoule head and an ampoule body which are connected to each other by way of a narrow ampoule neck. Immediately before using the fluid product the ampoule head is broken off from the ampoule body in the area of the ampoule neck, which constitutes a predetermined break point, so that the fluid product can be removed from the ampoule.

Various types of devices are known for breaking the ampoule head off from the ampoule body. These devices make it easier for the user to break the ampoule head off from the ampule body and to separate the resulting glass splinters from the fluid product. In addition, the spilling of part of the fluid product when breaking the ampoule is avoided.

Such devices for opening one or more ampoules are disclosed, for example in documents U.S. Pat. No. 6,296,149 and U.S. Pat. No. 5,335,824, in which the ampoules are each held in a housing which comprises two housing sections. The two housing sections can each be rotated relative to each other about an axis of rotation and the ampoules are arranged eccentrically with regard to this axis of rotation in the housing in such a way that rotating the two housing sections exerts a lateral shearing force on the ampoule head. As the ampules are arranged eccentrically with regard to the axis of rotation these devices require a relatively large amount of space.

In document WO 97/07748 a device is disclosed in which the ampoule body is held in a housing and in which the ampoule head projects into an ampoule head holder. The ampoule head is broken off in that the housing is rotated relative to the ampoule head holder about an axis of rotation which is perpendicular to the longitudinal axis of the ampoule. However, the device is complex in design and correspondingly costly to manufacture.

In documents U.S. Pat. No. 984,654 and U.S. Pat. No. 6,099,510 devices are described in which the ampoule is pressed longitudinally with the ampoule head against a ramp, as a result of which a lateral force component acts on the ampoule head. These devices have the drawback that a relatively large amount of force is required to break the ampoule.

Further devices for opening ampoules are disclosed in documents U.S. Pat. No. 6,832,703, DE 29 21 565, DE 198 41 722 and EP 0 079 983.

SUMMARY OF THE INVENTION

It is an object of the present invention to set out a device for opening an ampoule in which the force used to break open the ampoule is minimised. The device should also be easy to use and should be designed as simply and compactly as possible.

The present invention therefore provides a device for opening an ampoule, more particularly a glass ampoule with an ampoule body and an ampoule head, comprising:

- a housing with a proximal end, with a distal end and with at least one side wall, which is essentially of a hollow cylindrical design and thereby defines a radial direction and a longitudinal axis which extends from the proximal end to the distal end and which delimits, in the radial direction, an interior for accommodating an ampoule, and
- at least one rotary element with a proximal section, connected to which is a break-off section which extends in the distal direction and is flexible in the radial direction and/or is pivotably connected to the proximal section in the radial direction.

The rotary element is configured to be rotated relative to the housing about the longitudinal axis in an actuating direction from an initial position into an intermediate position. In the area of the side wall the housing further has a first guiding structure which is designed in such a way that during rotation from the initial position into the intermediate position it presses the break-off section radially inwards so that the break-off section exerts a radial shearing force on the ampoule head of an ampoule accommodated in the interior in order to break the ampoule head off from the ampoule body.

In such a design of the device the rotary force produced by the user is converted into a radial shearing force acting perpendicularly to the longitudinal axis of the ampoule. The shearing force also acts optimally from the side on the ampoule head, i.e. from a direction perpendicular to the longitudinal axis of the ampoule. More particularly, in a preferred embodiment it is possible to position the break-off section in such a way relative to the ampoule head that the shearing force acts on the ampoule head as far as possible from the predetermined breaking point. This achieves a lever effect, which reduces the force required for breaking off the ampoule head. The force for breaking open the ampule is minimised through this design of the device.

The ampoule usually has a radially tapering neck section which forms a predetermined breaking point. The neck section is arranged between the ampoule body and the ampoule head. In addition to, or instead of, a neck section the ampoule can be externally scored circumferentially or on one side in order to produce a predetermined breaking point. Preferably, during the procedure described above the ampoule head is separated from the ampoule body in such a way that the ampoule head is not yet fragmented but essentially remains intact. Fragmentation of the ampoule head can then take place in a subsequent procedure.

In a preferred embodiment the housing is essentially designed as a hollow cylinder, more particularly an essentially circular hollow cylinder. At the distal end there is preferably an outlet opening which is optionally closed with a fluid-permeable filter element. At the proximal end the rotary element is preferably sealed vis-à-vis the housing. The housing is intended in particular to take up the fluid contained in the ampoule after breaking off the ampoule head. However, it also acts as a transport securing device for the fragile ampoule.

The angular range covered by the rotary element relative to the housing from the initial position to the intermediate position is preferably less than 90°. The break-off section can be directly or indirectly connected with the proximal section of the rotary element.

Preferably, formed at the proximal end of the housing is an insert opening through which the ampoule and the rotary element can be pushed into the interior. Preferably in the proximal area the rotary element has a sleeve-like section which extends into the interior and circumferentially surrounds the ampoule in its inserted state. On the radial outer side of this sleeve-like section a circumferential sealing element is preferably arranged which seals off the rotary element and housing from each other in a fluid-tight manner. The rotary element also preferably has a cover surface which closes the insert opening.

The rotary element preferably has a proximal actuating grip accessible to a user by means of which the rotary element can be rotated relative to the housing. Markings can be provided on the outside of the housing and the rotary element to indicate the rotary position of the rotary element relative to the housing.

The first guiding structure can, in particular, be designed in such a way that is has a guiding surface directed essentially radially towards the interior and converging in the circumferential direction towards the longitudinal axis in such a way that during a rotary movement of the rotary element relative to the housing from the initial position into the intermediately position it increasingly presses the break-off section radially inwards.

Preferably the first guiding structure is arranged directly on the inner side of the side wall. The first guiding structure is preferably formed by a radial recess arranged on the inner side of the side wall.

Preferably the housing has a first engaging structure and the rotary element has a second engaging structure, whereby the first engaging structure interacts with the second engaging structure in such a way that a rotary movement of the rotary element relative to the housing is essentially only possible in the actuating direction. The first and the second engaging structure thus jointly prevent a rotary movement of the rotary element contrary to the actuating direction and thereby form a one-way ratchet connection. As the rotary element cannot therefore be turned back against the actuating direction, the user can recognise whether the device has already been used and ampoule opened or not.

In a preferred embodiment the rotary element has a fragmentation section which is flexibly designed in the radial direction and/or is pivotably arranged on the proximal section of the rotary element in the radial direction, and to which the break-off section is adjoined in the distal direction. The rotary element can then preferably be rotated further relative to the housing in the direction of operation from the intermediate position into an end position, wherein in the area of the side wall the housing has a second guiding structure, which is designed so that during rotation from the intermediate position into the end position it presses the fragmentation section radially inwards so that the ampoule head of an ampoule accommodated in the interior is fragmented after having been broken off. In this embodiment the ampoule is thus opened in such a way that the ampoule head is first broken off from the ampoule body and then fragmented. Compared with direct fragmentation of an ampoule head, which has not been broken off from the ampoule body beforehand, the maximum force exerted when opening an ampoule in this manner is essentially minimised as the external forces acting on the ampoule head are not absorbable by the ampoule body through internal force equalisation. Fragmenting prevents liquid residues of the fluid product remaining in the ampoule head. Preferably the breaking off and subsequent fragmentation of the ampoule head take place in a single procedure, for example through a continuous rotary movement of the rotary element relative to the housing. The range of rotation of the rotary element relative to the housing is preferably limited, and the angular range of this limited range of rotation is preferably approximately 180°.

The fragmentation section of the rotary element preferably has two or more elements which are arranged opposite one another in the radial direction. Accordingly the second guiding structure then also has two or more elements which are also arranged opposite one another. As a result the ampoule head is pressed together from at least two opposite sides and advantageously fragmented into a large number of glass splinters.

The rotary element advantageously has a sleeve-like section which is arranged proximally adjacent to the fragmentation section and which has several longitudinal slits arranged opposite to one another in the radial direction. The sleeve-like section can, in particular, serve to hold the ampoule body in position when the ampoule head is broken off. The longitudinal slits are intended to increase the flexibility of the rotary element and, more particularly, to facilitate the pressing together of the possibly present opposite elements of the fragmentation section.

The second guiding element can in particular be designed so that it has a guiding surface essentially directed radially towards the interior and converging in the circumferential direction towards the longitudinal axis so that during a rotary movement of the rotary element relative to the housing from the intermediate into the end position it presses the fragmentation section radially inwards.

Advantageously the second guiding structure is arranged proximally to the first guiding structure. Preferably the second guiding structure is formed directly on the inner side of the side wall. The second guiding structure is advantageously formed by at least one radial protrusion of the side wall projecting into the interior.

Preferably the fragmentation section thickens radially in a circumferential direction contrary to the actuating direction. On rotating the rotating element relative to the housing from the intermediate position into the end position the fragmentation section is thereby increasingly pressed radially inwards towards the longitudinal axis, as a result of which the external force acting on the ampoule head is increased. To increase its flexibility the fragmentation section can have longitudinal grooves on its radial outer side. The break-off section can also have longitudinal grooves on its radial outer side.

The device can comprise two or more rotary elements and a housing with two or more connected side walls which each define an interior for accommodating an ampoule. The device then also has a grip element and a force transmission structure, which transmits a rotary force acting on the grip element to all rotary elements so that the ampoule heads of several ampoules can be broken off through one rotary movement of the grip element. More particularly the force transmission structure can be a toothed wheel connection between the grip element and the rotary elements. The grip element can be designed as an actuating grip formed on one of the rotary elements or also as a separate actuating element which is in connection with the rotary elements. More particularly, the device can be designed in such a way that all ampoule heads break off essentially simultaneously. However, alternatively the device can be designed so that the ampoule heads break off consecutively as the grip element is continuously rotated. In this alternative embodiment the entire force for breaking off all the ampoule heads is then distributed over several rotary positions of the grip element. In such a device which is suitable for holding several ampoules the outlet openings can be brought together in a mixer element in order to mix the various substances contained in the ampoules. However, the outlet openings can also be continued separately in order, for example, to be connected to a double or multiple syringe.

BRIEF DESCRIPTION OF THE DRAWINGS

Preferred embodiments of the invention will be described below with the aid of the drawings, which are only intended for explanation and are not to be interpreted as limiting. In the drawings.

DESCRIPTION OF PREFERRED EMBODIMENTS

Figure 1:
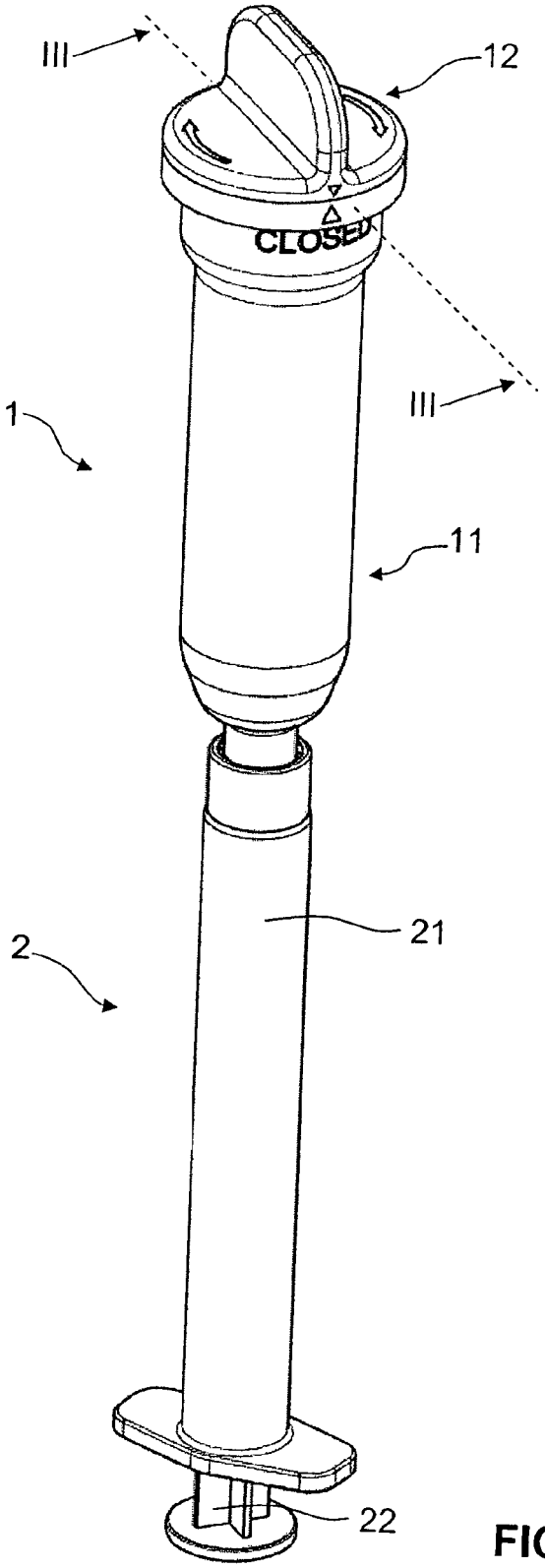
FIG. 1 is a perspective view of a first embodiment of a device in accordance with the invention for opening an ampoule in the initial position and with an attached syringe.

FIGS. 1 to 16 show a first embodiment of an opening device in accordance with the invention. The opening device 1, which comprises a housing 11 and a rotary element 12 inserted into the housing 11, is intended for opening an ampoule 3 and is here connected to a syringe 2. To open the ampoule 3 the rotary element 12 can be rotated relative to the housing 11 in an actuating direction. In the following the actuating direction is always the circumferential direction in which the rotary element 12 is rotated relative to the stationary housing 11 in order to open the ampoule 3. The distal direction of the opening device 1 extends from a proximal insert opening of the housing 11 to a distal outlet opening 113 and corresponds with the direction in which the ampoule 3 can be inserted with the ampoule head 33 first into the opening device 1. The proximal direction is the direction contrary to the distal direction.

Figure 2:
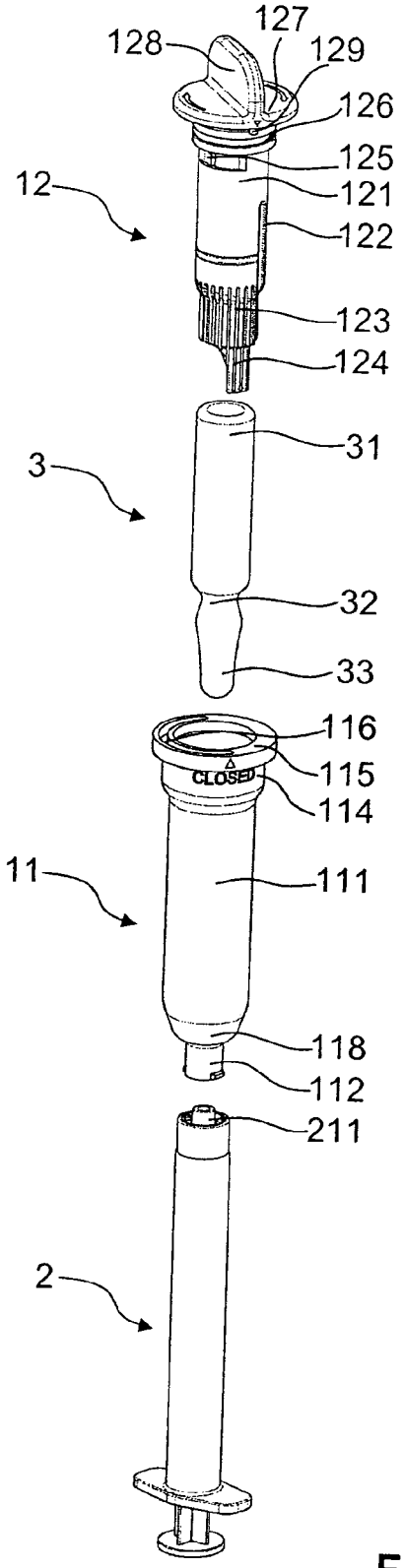
FIG. 2 is an exploded view of the device in accordance with FIG. 1 with a syringe.

The ampoule 3, which can be seen more particularly in FIG. 2, is an elongated closed glass vessel containing a fluid substance, such as, for example, a medicinal product or a monomer of an adhesive or bone cement. The ampoule 3 has a hollow cylindrical ampoule body 31 on which an ampoule head 33 is arranged via an ampoule neck 32. The ampoule neck 32 is a circumferential radially narrowed section of the ampoule 3. This narrowed section constitutes a predetermined breaking point and is intended to facilitate the breaking off of the ampoule head 33 from the ampoule body 31. The ampoule neck 32 can also be scored circumferentially or on one side in order to further facilitate the breaking off of the ampoule head 33 from the ampoule body 31.

Figure 3:
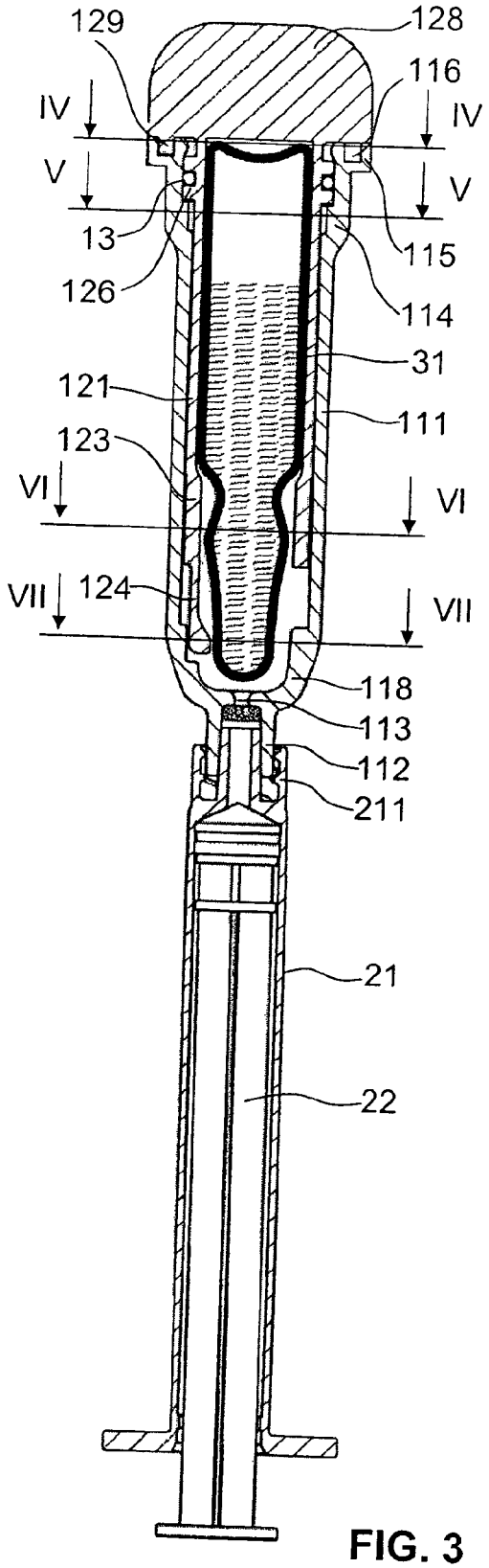
FIG. 3 is a sectional view in plane III-III of the device shown in FIG. 1 in the initial position with an attached syringe.
Figure 4:
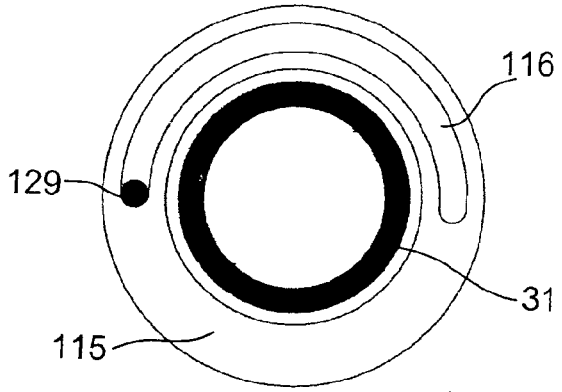
FIG. 4 is a sectional view in plane IV-IV of the device shown in FIG. 3.
Figure 5:
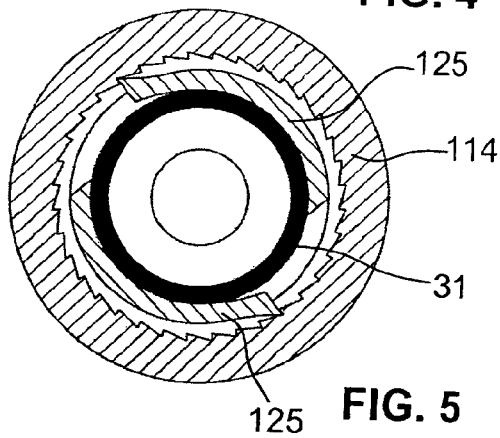
FIG. 5 is a sectional view in plane V-V of the device shown in FIG. 3.
Figure 6:
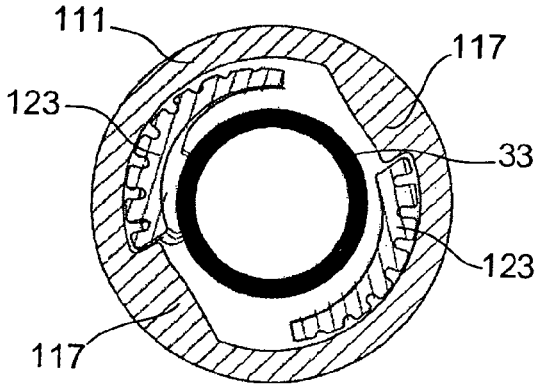
FIG. 6 is a sectional view in plane VI-VI of the device shown in FIG. 3.
Figure 7:
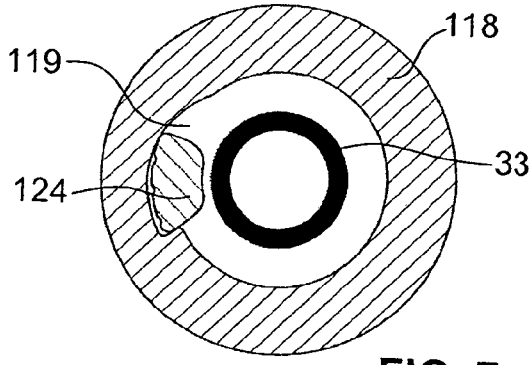
FIG. 7 is a sectional view in plane VII-VII of the device shown in FIG. 3.

The housing 11 has, as can be seen in FIGS. 1 to 3 in particular, a side wall 111 which as a result of its circular cylindrical form defines a radial direction as well as a longitudinal axis of the opening device 1. In the radial direction the side wall 111 delimits an interior of the housing 11 which serves to accommodate the ampoule 3. In the present embodiment the housing 11 has a proximal insert opening through which the ampoule 3 can be pushed with the ampoule head 33 first into the interior. The rotary element 12 can also be pushed through the inset opening into the interior whereby it receives the proximal end of the ampoule 3.

On its radial inner side in a distal area the side wall 111 has a first guiding structure 119 in the form of a recess. This first guiding structure 119 has an essentially radially inwardly directed guiding surface which in the actuating direction steadily converges towards the longitudinal axis of the opening device 1 over an angular range of not quite 90°. In the circumferential direction contrary to the actuating direction the first guiding structure 119 has a stop surface facing into the actuating direction.

In an area which is arranged proximally in relation to the first guiding structure 119 the side wall 111 has a second guiding structure 117 in the form of two diametrically opposite protrusions arranged on the inside of the side wall 111. The protrusions 117 each have a guiding surface which is essentially directed radially inwards and in the actuating direction converges towards the longitudinal axis of the opening device 1 over an angular range of approximately 45°. In the same way as the first guiding structure 119 the second guiding structure 117 also has a stop surface facing into the actuating direction.

At its distal end the side wall 111 merges into a transition section 118 narrowing in the distal direction which at its distal end delimits an outlet opening 113. To connect further devices to the opening device 1, such as syringes or connection tubes for example, in the area of the outlet opening 113 there is a coupling component in the form of a Luer connector 112. The Luer connector 112 has a female conical section which has a locking structure on its radial outer side. Within this female Luer cone the outlet opening 113 is closed by way of a filter insert. This filter insert is permeable to the fluid substance contained in the ampoule 3, but not to solid components, such as glass splinters in particular.

At its proximal end the side wall 111 merges into a widened section 114 which compared with the side wall 111 has a larger outer and inner diameter. At its proximal end the widened section 114 defines the insert opening of the housing 11 in the radial direction. At its proximal end the widened area 114 also has edge section 115 which circumferentially projects outwards from the housing 11 in the radial direction. The edge section 115 has a contact surface facing the proximal direction in which a groove 116 is formed. The groove 116 extends over an angular range of 180° and has two end surfaces facing the circumferential direction.

On the radial inner side of the widened section 114 there are circumferentially arranged engaging teeth which each have a stop surface facing into the actuating direction.

On the radial outer side or the widened section 114 markings are applied on two diametrically opposite sides to indicate a closed or opened state of the ampoule 3 accommodated in the interior of the housing 11.

The rotary element 12 has a sleeve-like section 121 in which two diametrically opposite longitudinal slits 122 are formed. The two longitudinal slits 122 extend from the distal end of the sleeve-like section 121 in the proximal direction so that they are open in the distal direction. Arranged at the distal end of the sleeve-like section 121 is the fragmentation section 123 consisting of two diametrically opposite elements. The opposite elements of the fragmentation section 123 each extend in the circumferential direction over an angular range of approximately 120°. Each of the two elements of the fragmentation section 123 is flexible and has longitudinal grooves on its radial outer side. These longitudinal grooves are intended for increasing the flexibility of the fragmentation section 123. In a circumferential direction contrary to the actuating direction the two elements of the fragmentation section 123 thicken radially.

At the distal end of one element of the fragmentation section 123 there is a break-off section 124 projecting in the distal direction. This break-off section 124 also has longitudinal grooves on its radial outer side. However this break-off section 124 extends over a substantially smaller angular range than the opposite elements of the fragmentation section 123.

Formed in a proximal area of the sleeve-like section 121 are two radially opposite engaging elements 125 slightly projecting outwards in the radial direction.

The engaging elements 125 each have a stop surface which essentially faces in a direction contrary to the actuating direction. The engaging elements 125 are flexibly designed so that they can be moved elastically inwards in the radial direction.

The sleeve-like section 121 also has a circumferential groove 126 which is arranged proximally of the engaging elements 125 and which is defined in the proximal and distal direction by two flanges projecting radially outwards from the sleeve-like section 121. A sealing ring 13 is accommodated in the groove 126.

The sleeve-like section 121 is connected with its proximal end to a plate-shaped, circular cover surface 127 which closes the sleeve-shaped section 121 in the proximal direction. The cover surface 127 has a similar radius to the edge area 115 of the casing 11 and is accordingly designed to lie on the edge section 115. On the underside of the cover surface 127 facing in the distal direction there is a projection 129 in a section projecting from the sleeve-like section 121 outwards. The projection 129 extends in the distal direction into the groove 116 of the housing 11.

On the upper side of the cover surface 127 facing the proximal direction an actuating grip 128 extends diametrically over the cover surface 127.

On the upper side of the cover surface 127 there are also markings in the form of arrows which indicate the direction of actuation of the rotary element 12 for opening the ampoule 3. In addition, on the radial outer side of the cover surface 127 a further marking is applied for indicating to the user the rotary position of the rotary element 12 relative to the housing 11.

In the present embodiment the housing 11 and the rotary element 12 are each designed in one piece and are made of a plastic material in an injection moulding process. Both the housing 11 and the rotary element 12 can, however, also be produced in a multiple component injection moulding process, or even designed in multiple parts. As the filter insert provided at the outlet opening 113, a sintered layer or a perforated film can be used for example. More particularly the filter insert can be moulded onto the housing in one piece. The sealing ring 13 can also be designed in one piece with the rotary element 12 or, alternatively, it can be omitted. Due to its elastic properties polybutylene terephthalate (PBT) or polypropylene (PP), for example, are suitable as materials for the rotary element 12. As the material for the housing 11, polycarbonate or a polyolefin-based material can be used for example, such as, in particular, polypropylene (PP) or polyethylene (PE).

The functioning of the opening device 1 is graphically illustrated in particularly in FIGS. 3 to 16.

FIGS. 3 to 7, in the same way as FIG. 1, show the opening device 1 in an initial position. The ampoule 3 is pushed into the interior or the housing 11 with the ampoule head 33 first. Also pushed into the interior of the housing 11 is the rotary element 12 which surrounds the ampoule 3 in a contacting manner at least in its proximal section in the radial direction. The sealing ring 13 circumferentially seals the rotary element 12 vis-à-vis the housing 11. The cover surface 127 of the rotary element 12 rests on the edge section 115 of the housing 11. The break-off section 124 is arranged in the area of the distal end of the ampoule head 33, and the fragmentation section 123 in the area of the ampoule head 33 where the ampoule head 33 has a maximum radial extent. The engaging elements 125 engage in the engaging tooth formed on the widened section 114 of the housing 11 in such a way that the stop surfaces of the engaging element 125 are opposite the stop surfaces of the engaging teeth. The rotary element 12 can therefore only be rotated in the actuating direction relative to the housing 11 and a rotary movement contrary to the actuating direction is prevented by the contacting of the opposing stop surfaces.

In this initial position the ampoule 3 is intact and closed.

In relation to the housing 11 in the initial position, in relation to the longitudinal direction the two opposite elements of the fragmentation section 123 are arranged in the area of the second guiding structure 117, both elements of the fragmentation section 123 each being arranged in the circumferential direction between the two opposite protrusions. In the initial position the break-off section 124 is arranged in the area of the first guiding structure 119, namely in such a way that it is held in the recess of the side wall 111, which forms the first guiding structure 119, adjacent to the stop surface facing in the actuating direction.

In the initial position, in relation to the groove 116 the projection 129 is arranged in such a way in the circumferential direction that it forms a stop with the end surface of the groove 116 facing in the actuating direction. The rotary element 12 can therefore exclusively be rotated in the actuating direction relative to the housing 11. In addition, the stop surfaces of the first and second guiding structures 117 and 119 prevent rotation of the rotary element 12 relative to the housing 11 contrary to the actuating direction.

The marking applied on the radial outer sides of the housing 11 and the rotary element 12 indicates the initial position and thus the intactness of the ampoule 3 to the user (FIG. 1).

Figure 8:
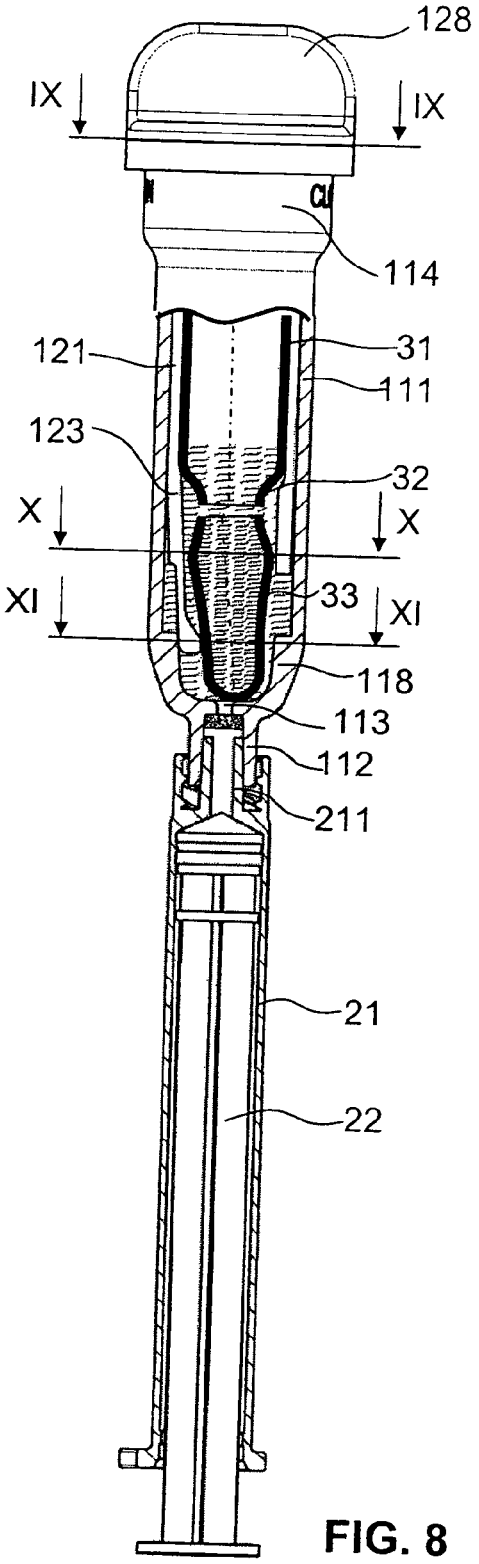
FIG. 8 is a partial cross-sectional view in plane III-III of the device shown in FIG. 1 in the intermediate position with an attached syringe.
Figure 9:
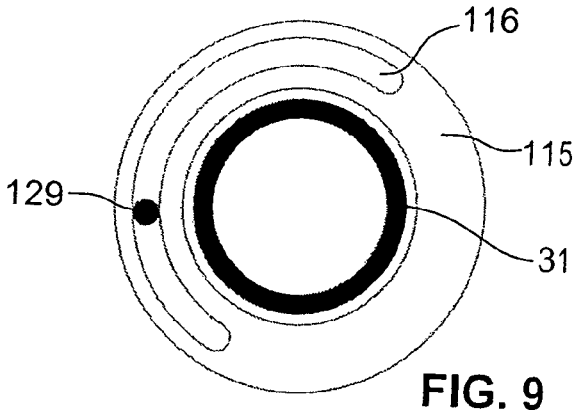
FIG. 9 is a sectional view in plane IX-IX of the device shown in FIG. 8.
Figure 10:
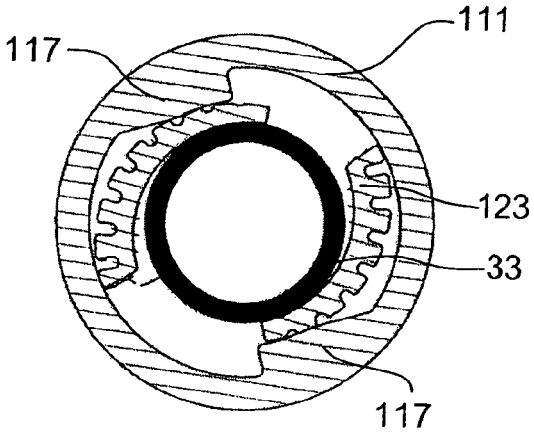
FIG. 10 is a sectional view in plane X-X of the device shown in FIG. 8.
Figure 11:
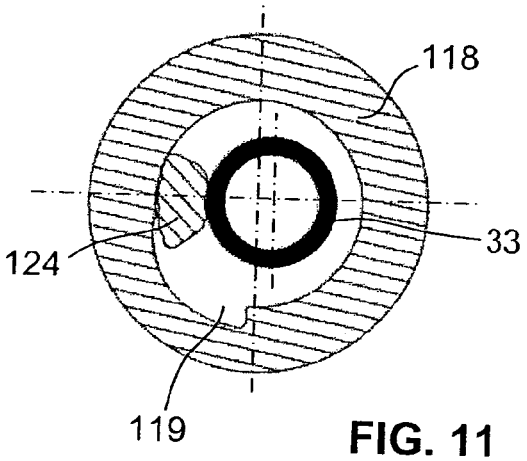
FIG. 11 is a sectional view in plane XI-XI of the device shown in FIG. 8.

In FIGS. 8 to 11 the opening device 1 is shown in an intermediate position, whereby the rotary element 12 has been rotated about an angular range of slightly more than 45° relative to the housing 11 compared with the initial position. Due to this rotation in the actuating direction the break-off section 124 has been pressed radially inwards and against the ampoule head 33 by the guiding surface of the first guiding structure 119. As shown in FIG. 11 the ampoule head is thus pushed away from is central position in relation to the longitudinal axis. As at the same time the ampoule body 31 is held tightly in the sleeve-like section 121 and is therefore immobile in the radial direction, a radial shearing force is exerted in the area of the ampoule neck 32. This shearing force is so great that the ampoule head 33 breaks off from the ampoule body 31 in the area of the ampoule neck 32 (FIG. 8).

As the break-off section is arranged in the area of the distal end of the ampoule head 33 it exerts an external force on the ampoule head 33 which acts optimally on the ampoule 3. More particularly, due to the distance between the ampoule neck 32 and the point at which the external force acts on the ampoule head 33, a lever effect is produced which minimises the force required for breaking off the ampoule head 33 from the ampoule body 31. This external force also acts optimally on the ampoule head 33 from the side in a direction perpendicular to the longitudinal axis of the ampoule 3.

In the intermediate position the fragmentation section 123 is in contact with the second guiding structure 117 with its radial outer side, while it does not yet exert any substantial pressure on the ampoule head 33.

Figure 12:
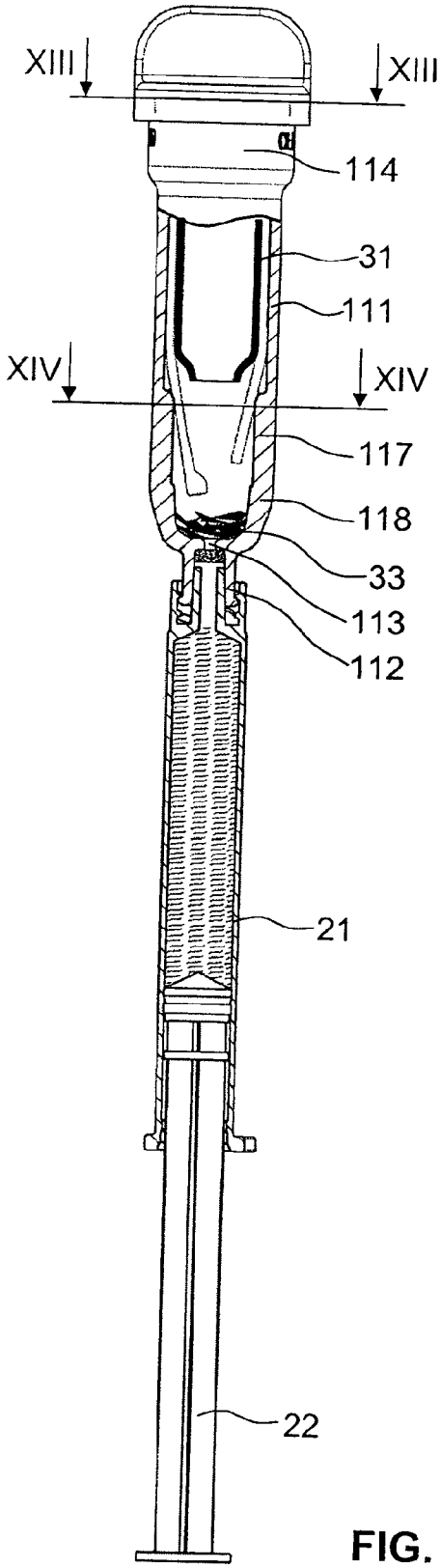
FIG. 12 is a partial sectional view in plane III-III of the device shown in FIG. 1 close to the end position with an attached syringe.
Figure 13:
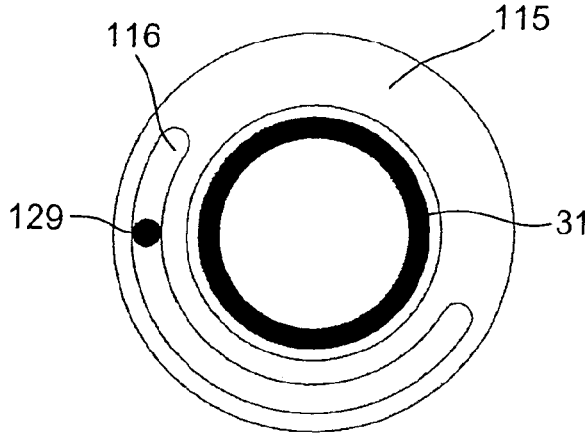
FIG. 13 shows a sectional view in plane XIII-XIII of the device shown in FIG. 12.
Figure 14:
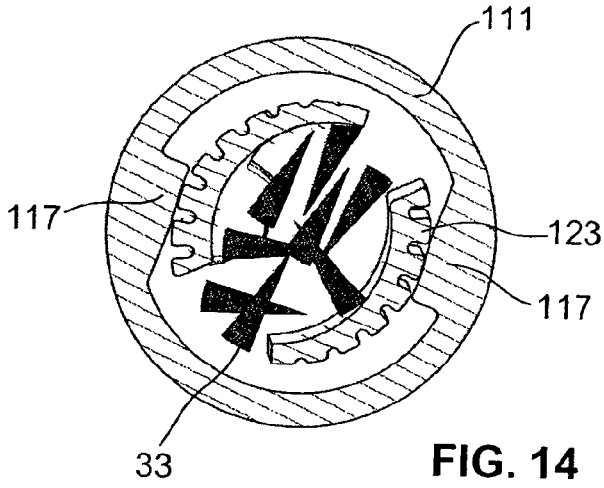
FIG. 14 shows a sectional view in plane XIV-XIV of the device shown in FIG. 12.

In the situation shown in FIGS. 12 to 14 the rotary element 12 has been rotated further in the actuating direction relative to the housing 11 compared with the intermediate position. Relative to the housing 11 the rotary element 12 is now close to an end position. Through the two protrusions of the second guiding structure 117 the two opposite elements of the fragmentation section 123 have been pushed radially inwards and thus from two diametrically opposite sides against the ampoule head 33 which has been broken off from the ampoule body 31. This radial pressing in of the two opposite elements of the fragmentation section 123 is facilitated by the longitudinal slits 122 formed in the sleeve-like section 121 as well as by the longitudinal grooves formed on the outer side of the fragmentation section 123, as both the longitudinal slits 122 and the longitudinal grooves substantially increase the flexibility of the fragmentation section 123 in relation to the proximal section of the rotary element 12. Due to the radial movement of the fragmentation section 123 towards the longitudinal axis of the opening device 1 the space in which the ampoule head 33 is held decreases and the ampoule head 33 is pressed together from two opposite sides. With any further rotation of the rotary element 12 in the actuating direction the two opposite elements of the fragmentation section 123 are radially pressed further inwards until the ampoule head 33 finally fragments. As the ampoule head 33 has already been broken off from the ampoule body 31 in a previous step a small force is required for this fragmentation of the ampoule head 33 as the forces acting in the interior of the ampoule head 33 can no longer be absorbed by the ampoule body 31.

As shown in FIG. 12 the fluid substances can now be drawn up into a syringe 2. To connect the syringe 2 to the opening device 1 the syringe 2 has a male Luer connection 211 designed to complement the female Luer connection 112 of the housing 11. The syringe 2 has a housing 21 into which the fluid substance can be drawn up by way of retracting a plunger 22. The glass splinters of the fragmented ampoule head 33 are retained by the filter insert arranged at the outlet opening 113 and remain in the opening device 1.

Figure 15:
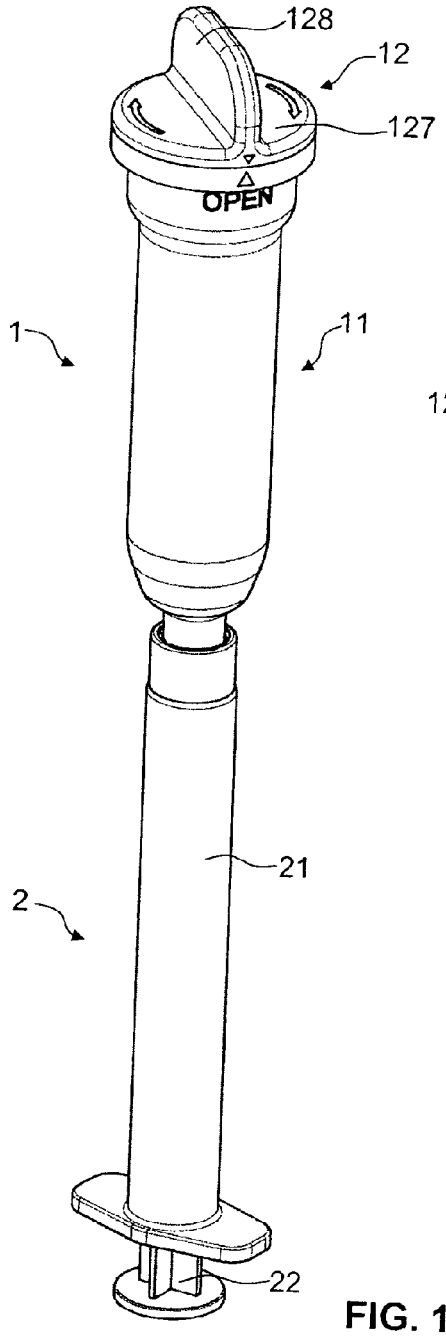
FIG. 15 shows a perspective view of the device shown in FIG. 1 in the end position with an attached syringe.
Figure 16:
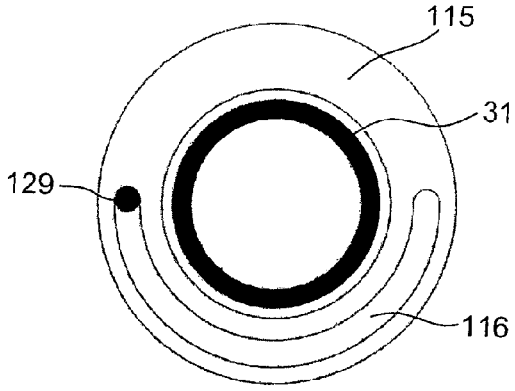
FIG. 16 shows a sectional view in plane XIII-XIII of the device shown in FIG. 12 in the end position.

In FIGS. 15 and 16 the opening device 1 is shown in its end position. The projection 129 forms a stop with end surface of the groove 116 facing against the actuating direction. Further rotation of the rotary element 12 relative to the housing 11 in the actuating direction is thereby prevented. The stop surfaces of the first and second guiding structures 117 and 119 also prevent the rotary element 12 being turned back relative to the housing 11 against the actuating direction. The markings provided on the outer sides of the housing 11 and the rotary element 12 indicate to the user that the opening device 1 has been manipulated and thus that the ampoule 3 has been opened. The housing can also be transparent, more particularly in the distal section or have a transparent window so that the user can recognise the condition of the ampoule head 33 from outside.

In an alternative embodiment which is not shown in the drawings, the housing of the opening device 1 has two or more connected side walls 111 which each define an interior for accommodating an ampoule 3. Into each of these interiors a rotary element 12 is inserted which is used for opening the relevant ampoule 3. The opening device 1 then also has a rotating grip element which is connected to all the rotary elements 12 via a force transmission structure. The force transmission structure is designed as a plurality of toothed wheels whereby one toothed wheel is arranged on each of the rotary elements as well as on the grip element. The toothed wheels engage in each other in such a way that a rotary movement of the grip element is directly converted into a rotary movement of the rotary elements. The toothed wheels can each have a different number of teeth to transmit the rotary movement between the grip element and the rotary elements. The force used to open an ampoule 3 can be minimised further through such a design.

The invention is not of course restricted to the above exemplary embodiments, and a large number of modifications is possible. The first guiding structure 119 and the second guiding structure 117 do not necessarily have to be designed in the form of recesses and/or protrusions of the side wall 111 for example. Further elements arranged in the interior of the housing 11 can be provided which form the first guiding structure 119 and/or the second guiding structure 117. The engaging elements 125 of the rotary element 12 and the engaging teeth formed on the widened section 114 of the housing 11 are optional and do not necessarily have to be provided. The provision of the projection 129 and the groove 116 which jointly limit the rotary movement of the rotary element 12 relative to the housing 11 is also not mandatory.

In a simplified embodiment the fragmentation section 123 can be dispensed with. In this case the ampoule head 33 is, however, only broken off from the ampoule body and not fragmented. It is then possible that a fluid contained in the ampoule head 33 is retained in the opening device. The fragmentation section 123 can also only comprise one of the opposite elements, which presses the ampoule head 33 against a diametrically opposite counter-component. The counter-component can be formed on the housing 11 or on another element. However, the fragmentation section 123 can also comprise more than two elements which are diametrically opposite one another. Accordingly the second guiding element 117 would then have several elements arranged opposite each other. A large number of further modifications are possible.

The invention claimed is:

1. A device for opening an ampoule having an ampoule body and an ampoule head, the device comprising:

a hollow cylinder housing having a proximal end, a distal end, and a side wall, the housing defining a longitudinal axis extending from the proximal end to the distal end, the housing delimiting an interior for accommodating an ampoule; and a rotary element configured to be rotated about the longitudinal axis relative to the housing in an actuating direction, the rotary element having a proximal section and a fragmentation section connected to the proximal section, the hollow cylinder housing having a first guiding structure with a first guiding surface that is directed toward the interior of the housing, the first guiding surface having a distance from the longitudinal axis that continuously decreases over a first angular range along a circumferential direction, the first guiding surface being arranged in a first side wall region of the hollow cylinder housing so as to press the fragmentation section radially inward when the rotary element is rotated in the actuating direction, the first guiding structure being formed by at least one radial protrusion of the side wall projecting into the interior.

2. The device in accordance with claim 1, wherein the fragmentation section is connected to the proximal section in such a manner that the fragmentation section is movable radially inward toward the longitudinal axis relative to the proximal section.

3. The device in accordance with claim 1, wherein the housing has a first engaging structure and the rotary element has a second engaging structure, the first engaging structure interacting with the second engaging structure such that a ratchet connection is formed so as to prevent a rotary movement of the rotary element relative to the housing counter to the actuating direction.

4. The device in accordance with claim 1, wherein the fragmentation section radially thickens along a circumferential direction contrary to the actuating direction.

5. The device in accordance with claim 1, wherein the rotary element has a break-off section connected to the fragmentation section, the break-off section projecting along the longitudinal axis, the hollow cylinder housing having a second guiding structure defining a second guiding surface that is directed toward the interior of the housing, the second guiding surface having a distance from the longitudinal axis that, in a plane perpendicular to the longitudinal axis, continuously decreases over a second angular range along a circumferential direction, the second guiding surface being arranged in a second side wall region of the housing, the second side wall region being distal from the first side wall region, so as to press the break-off section radially inward when the rotary element is rotated from an initial position into an intermediate position, causing the break-off section to exert a radial shearing force on the ampoule head when an ampoule is accommodated in the interior, in order to break off the ampoule head from the ampoule body.

6. A device for opening an ampoule having an ampoule body and an ampoule head, the device comprising:

a hollow cylinder housing having a proximal end, a distal end, and a side wall, the housing defining a longitudinal axis extending from the proximal end to the distal end, the housing delimiting an interior for accommodating an ampoule; and a rotary element configured to be rotated about the longitudinal axis relative to the housing in an actuating direction, the rotary element having a proximal section and a fragmentation section connected to the proximal section, the hollow cylinder housing having a first guiding structure with a first guiding surface that is directed toward the interior of the housing, the first guiding surface having a distance from the longitudinal axis that continuously decreases over a first angular range along a circumferential direction, the first guiding surface being arranged in a first side wall region of the hollow cylinder housing so as to press the fragmentation section radially inward when the rotary element is rotated in the actuating direction, the fragmentation section radially thickening along a circumferential direction contrary to the actuating direction.

7. The device in accordance with claim 6, wherein the fragmentation section is connected to the proximal section in such a manner that the fragmentation section is movable radially inward toward the longitudinal axis relative to the proximal section.

8. The device in accordance with claim 6, wherein the housing has a first engaging structure and the rotary element has a second engaging structure, the first engaging structure interacting with the second engaging structure such that a ratchet connection is formed so as to prevent a rotary movement of the rotary element relative to the housing counter to the actuating direction.

9. The device in accordance with claim 6, wherein the rotary element has a break-off section connected to the fragmentation section, the break-off section projecting along the longitudinal axis, the hollow cylinder housing having a second guiding structure defining a second guiding surface that is directed toward the interior of the housing, the second guiding surface having a distance from the longitudinal axis that, in a plane perpendicular to the longitudinal axis, continuously decreases over a second angular range along a circumferential direction, the second guiding surface being arranged in a second side wall region of the housing, the second side wall region being distal from the first side wall region, so as to press the break-off section radially inward when the rotary element is rotated from an initial position into an intermediate position, causing the break-off section to exert a radial shearing force on the ampoule head when an ampoule is accommodated in the interior, in order to break off the ampoule head from the ampoule body.

10. A device for opening an ampoule having an ampoule body and an ampoule head, the device comprising:

a hollow cylinder housing having a proximal end, a distal end, and a side wall, the housing defining a longitudinal axis extending from the proximal end to the distal end, the housing delimiting an interior for accommodating an ampoule; and a rotary element configured to be rotated about the longitudinal axis relative to the housing in an actuating direction, the rotary element having a proximal section and a fragmentation section connected to the proximal section, the hollow cylinder housing having a first guiding structure with a first guiding surface that is directed toward the interior of the housing, the first guiding surface having a distance from the longitudinal axis that, in a plane perpendicular to the longitudinal axis, continuously decreases over a first angular range along a circumferential direction, the first guiding surface being arranged in a first side wall region of the hollow cylinder housing so as to press the fragmentation section radially inward when the rotary element is rotated in the actuating direction, the fragmentation section having at least two elements which are arranged opposite to one another in the radial direction, the at least two elements each extending in the circumferential direction over an angular range being substantially larger than the first angular range.

11. The device in accordance with claim 10, wherein the fragmentation section is connected to the proximal section in such a manner that the fragmentation section is movable radially inward toward the longitudinal axis relative to the proximal section.

12. The device in accordance with claim 11, wherein the fragmentation section is capable of a pivoting movement relative to the proximal section.

13. The device in accordance with claim 11, wherein the fragmentation section is flexible so as to be movable radially inward toward the longitudinal axis.

14. The device in accordance with claim 10, wherein the housing has a first engaging structure and the rotary element has a second engaging structure, the first engaging structure interacting with the second engaging structure such that a ratchet connection is formed so as to prevent a rotary movement of the rotary element relative to the housing counter to the actuating direction.

15. The device in accordance with claim 10, wherein the fragmentation section radially thickens along a circumferential direction contrary to the actuating direction.

16. The device in accordance with claim 10, wherein the fragmentation section has an outside surface carrying longitudinal grooves to increase flexibility of the fragmentation section.

17. The device in accordance with claim 10, wherein at the proximal end of the housing an insert opening is formed through which the ampoule and the rotary element can be pushed into the interior.

18. The device in accordance with claim 10, wherein the rotary element has an actuating grip that is accessible and configured so as to be manually rotated relative to the housing.

19. The device in accordance with claim 10, wherein the proximal section of the rotary element has a sleeve-like configuration, the proximal section having longitudinal slits arranged opposite to each other in the radial direction.

20. The device in accordance with claim 10, wherein the first guiding structure is formed by at least one radial protrusion of the side wall projecting into the interior.

21. The device in accordance with claim 10, wherein the rotary element has a break-off section connected to the fragmentation section, the break-off section projecting along the longitudinal axis, the hollow cylinder housing having a second guiding structure defining a second guiding surface that is directed toward the interior of the housing, the second guiding surface having a distance from the longitudinal axis that, in a plane perpendicular to the longitudinal axis, continuously decreases over a second angular range along a circumferential direction, the second guiding surface being arranged in a second side wall region of the housing, the second side wall region being distal from the first side wall region, so as to press the break-off section radially inward when the rotary element is rotated from an initial position into an intermediate position, causing the break-off section to exert a radial shearing force on the ampoule head when an ampoule is accommodated in the interior, in order to break off the ampoule head from the ampoule body.

22. The device in accordance with claim 21, wherein the second guiding structure is formed by a radial recess which is arranged on the inner side of the side wall.

23. The device in accordance with claim 21, wherein the break-off section is connected to the fragmentation section in such a manner that the break-off section is movable radially inward toward the longitudinal axis relative to the proximal section.

24. The device in accordance with claim 21, wherein the break-off section is capable of a pivoting movement relative to the proximal section.

25. The device in accordance with claim 21, wherein the break-off section is flexible so as to be movable radially inward toward the longitudinal axis.

* * * * *